US006248211B1

(12) United States Patent
Jennings et al.

(10) Patent No.: US 6,248,211 B1
(45) Date of Patent: Jun. 19, 2001

(54) METHOD FOR MAKING A THROUGHDRIED TISSUE SHEET

(75) Inventors: Richard Douglas Jennings, Appleton; Zeinab Salman, Neenah, both of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/370,446

(22) Filed: Aug. 9, 1999

Related U.S. Application Data

(63) Continuation-in-part of application No. 08/876,548, filed on Jun. 16, 1997, now abandoned.

(51) Int. Cl.[7] ..... B31F 1/12

(52) U.S. Cl. ..... 162/111; 162/112; 162/113; 162/117; 162/205; 162/206

(58) Field of Search ..... 162/109, 111, 162/112, 113, 117, 205, 206; 264/282, 283

(56) References Cited

U.S. PATENT DOCUMENTS

| | | |
|---|---|---|
| 361,849 | 4/1887 | Taylor . |
| 1,541,977 | 6/1925 | Lorenz . |
| 1,548,790 | 8/1925 | Lorenz . |
| 3,104,197 | 9/1963 | Back et al. . |
| 3,266,416 | 8/1966 | Mittman . |
| 3,300,368 | 1/1967 | Cooper et al. . |
| 3,608,047 | 9/1971 | Wiggins . |
| 3,714,687 | 2/1973 | van Tilburg . |
| 4,135,024 | 1/1979 | Callahan et al. . |
| 4,208,459 | 6/1980 | Becker et al. . |
| 4,230,036 | 10/1980 | Groome . |
| 4,236,963 | 12/1980 | Busker . |
| 4,257,843 | 3/1981 | Watanabe et al. . |
| 4,300,981 | 11/1981 | Carstens . |
| 4,557,778 | 12/1985 | Held . |
| 4,803,032 | 2/1989 | Schulz . |
| 4,960,046 | 10/1990 | Anstötz et al. . |
| 5,091,032 | 2/1992 | Schulz . |
| 5,126,015 | 6/1992 | Pounder . |
| 5,223,092 | 6/1993 | Grinnell et al. . |
| 5,269,983 | 12/1993 | Schulz . |
| 5,314,584 | 5/1994 | Grinnell et al. . |
| 5,356,364 | 10/1994 | Veith et al. . |
| 5,383,778 | 1/1995 | Schulz . |
| 5,409,572 | 4/1995 | Kershaw et al. . |
| 5,468,323 | 11/1995 | McNeil . |
| 5,490,902 | 2/1996 | Schulz . |
| 5,503,896 | 4/1996 | Veith et al. . |
| 5,510,001 | 4/1996 | Hermans et al. . |
| 5,529,563 | 6/1996 | Veith et al. . |
| 5,597,639 | 1/1997 | Schulz . |
| 5,607,553 | 3/1997 | Chadha . |
| 5,609,098 | 3/1997 | Abe et al. . |
| 5,620,776 | 4/1997 | Schulz . |
| 5,656,134 | 8/1997 | Marinack et al. . |
| 5,672,248 | 9/1997 | Wendt et al. . |
| 5,693,403 | 12/1997 | Brown et al. . |
| 5,746,887 | 5/1998 | Wendt et al. . |
| 5,904,812 | 5/1999 | Salman et al. . |

FOREIGN PATENT DOCUMENTS

| | | |
|---|---|---|
| 0 495 637 A1 | 7/1992 | (EP) . |

OTHER PUBLICATIONS

TAPPI Official Test Method T 402 om–93, "Standard Conditioning and Testing Atmospheres for Paper, Board, Pulp Handsheets, and Related Products", published by the TAPPI Press, Atlanta, Georgia, revised 1993, pp. 1–3.

TAPPI Official Test Method T 411 om–89, "Thickness (Caliper) of Paper, Paperboard, and Combined Board", published by the TAPPI Press, Atlanta, Georgia, revised 1989, pp. 1–3.

*Primary Examiner*—Peter Chin
(74) *Attorney, Agent, or Firm*—Thomas J. Connelly; Patricia A. Charlier

(57) ABSTRACT

A method for making a throughdried tissue sheet is disclosed. The method includes the steps of depositing an aqueous suspension of papermaking fibers onto an endless forming fabric to form a wet web. The wet web is then transferred to a throughdrying fabric such that the wet web has a fabric side in contact with the throughdrying fabric and an opposite air side facing away from the throughdrying fabric. The wet web is routed over a throughdryer to dry the web. The web is then transferred to a Yankee dryer for further drying and is creped from the Yankee dryer to obtain a creped web having a basis weight of about 15.2 pounds per 2880 square feet. The creped web in then calendered in a calendering unit that includes a smooth calender roll and a resilient calender roll. The resilient calender roll has an exterior covering formed of ethylene propylene diene polymer and the creped web is oriented such that the fabric side is disposed toward the resilient calender roll. The finished tissue exhibits improved softness while retaining adequate strength.

19 Claims, 3 Drawing Sheets

METHOD FOR MAKING A THROUGHDRIED TISSUE SHEET

This application is a continuation-in-part of application Ser. No. 08/876,548 entitled SHEET ORIENTATION FOR SOFT NIP CALENDERING AND EMBOSSING OF CREPED THROUGHDRIED TISSUE PRODUCTS and filed in the U.S. Patent and Trademark Office on Jun. 16, 1997 now abandoned. The entirety of application Ser. No. 08/876,548 is hereby incorporated by reference.

FIELD OF THE INVENTION

The present invention relates to a method for making a throughdried tissue sheet exhibiting improved softness while retaining adequate strength. More particularly, the present invention relates to a method for making a creped throughdried tissue sheet using a resilient calender roll having an exterior covering formed of ethylene propylene diene polymer.

BACKGROUND OF THE INVENTION

A wide variety of product characteristics must be given attention in order to provide a tissue product with the appropriate blend of attributes suitable for the product's intended purposes. Contributing to this variety is the vast array of different product forms, such as facial tissue, bath tissue, napkins, and towels. Regardless of product form, however, improved softness of the product has long been one major objective, especially for premium products. In general, the major components of softness include stiffness and bulk, with lower stiffness and higher bulk generally improving perceived softness.

A throughdrying process can be used to improve the bulk of tissue products. Throughdrying is a relatively noncompressive method for removing water from a web. Specifically, a wet laid web is transferred from a forming fabric to a coarse, highly permeable throughdrying fabric and retained on the throughdrying fabric until it is dried by hot air passing through the web.

Throughdried sheets can be quite harsh and rough to the touch, however, due to their inherently high stiffness and strength and also due to the coarseness of the throughdrying fabric. For this reason, creping has been used to improve the softness of throughdried tissue sheets. Creping removes some of the stiffness of the uncreped sheet, albeit at the expense of the sheet strength.

Despite the improvements in softness that can be gained from creping, however, additional improvements in softness would be beneficial to consumers. Therefore, what is lacking and needed in the art is a process for further improving the softness of creped throughdried tissue products.

SUMMARY OF THE INVENTION

It has now been discovered that the texture of creped, throughdried tissue products can be improved by processing the tissue web through a soft-nip calendering unit with the fabric side of the web oriented toward a resilient roll and the air side of the web oriented toward a smooth roll. More specifically, in one embodiment the invention concerns a method for making a throughdried tissue sheet comprising the steps of depositing an aqueous suspension of papermaking fibers onto an endless forming fabric to form a wet web, and then transferring the wet web to a throughdrying fabric. The wet web is described herein as having a fabric side, which is the surface that is in contact with the throughdrying fabric, and an opposite air side, which is the surface that is facing away from the throughdrying fabric. The wet web is then carried over a throughdryer to dry the web, transferred to a Yankee dryer, and creped from the Yankee dryer. The creped web is then calendered in a calendering unit comprising a smooth calendering roll and a resilient calendering roll having a Shore A surface hardness of about 75 to about 100 Durometer (approximately 55 to about 0 Pusey & Jones, respectively). During calendering, the creped web is oriented such that the fabric side is disposed toward the resilient calendering roll.

In another embodiment, the method of making a throughdried tissue sheet also comprises the step of embossing the creped web in an embossing unit comprising a pattern roll and a backing roll. In the embossing unit, the creped web is oriented such that the fabric side of the web is disposed toward the pattern roll.

The improved softness is particularly pertinent to creped throughdried tissue products, which typically have larger creping features than a comparable wet pressed sheet. Moreover, the oriented soft-nip embossing is advantageously used in conjunction with oriented embossing of the tissue web. In particular, the resilient backing roll of the embossing unit is against the opposite surface of the tissue sheet as is the resilient calendering roll.

The texture of tissue products has been examined to determine the attributes that result in a tissue product being considered soft. One attribute of a surface of a tissue that is indicative of the softness of the tissue is referred to as the Fuzzy attribute of the tissue surface. Contrariwise, attributes of a tissue surface that are counter-indicative of the softness of the tissue are referred to as the Gritty and Grainy attributes of the tissue surface.

The methods disclosed herein have been found to increase the Fuzzy attribute of the fabric side of the tissue product and reduce the Gritty and Grainy textures of the air side of the tissue product. The Fuzzy attribute is increased, particularly on the fabric side, as a result of frictional forces in the calendering nip caused by the speed differential at the contact point between the resilient calendering roll and the steel calendering roll. The creping process causes the air side of the tissue web to have pointed crepe structures such as ripples or ridges which result in Gritty and Grainy textures, and that contact between the steel calendering roll and the air side tends to flatten the pointed crepe structures present on the air side, thereby reducing the Gritty and Grainy textures. In addition, it is hypothesized that the clarity of the embossing pattern is improved because of an increase in opacity caused by calendering the sheet. The result of the selective orientation and distinctive treatment of the opposite surfaces of the creped throughdried tissue is an embossed tissue web with enhanced softness.

For purposes herein, a "tissue web" or "tissue sheet" is a cellulosic web suitable for making or use as a facial tissue, bath tissue, paper towels, napkins, or the like. It can be layered or unlayered, creped or uncreped, and can consist of a single ply or multiple plies. In addition, the tissue web can contain reinforcing fibers for integrity and strength. Tissue webs suitable for use in accordance with this invention are characterized by being absorbent, of low density and relatively fragile, particularly in terms of wet strength. Densities are typically in the range of from about 0.1 to about 0.3 grams per cubic centimeter. Absorbency is typically about 5 grams of water per gram of fiber, and generally from about 5 to about 9 grams of water per gram of fiber. Wet tensile strengths are generally about 0 to about 300 grams per inch of width and typically are at the low end of this range, such as from about 0 to about 30 grams per inch. Dry tensile strengths in the machine direction can be from about 100 to about 2000 grams per inch of width, preferably from about 200 to about 350 grams per inch of width. Tensile strengths in the cross-machine direction can be from about 50 to about 1000 grams per inch of width, preferably from about 100 to about 250 grams per inch of width. Dry basis weights are generally in the range of from about 5 to about 60 pounds per 2880 square feet. The tissue webs referred to above are preferably made from natural cellulosic fiber sources such as hardwoods, softwoods, and nonwoody species, but can also contain significant amounts of recycled fibers, sized or chemically-modified fibers, or synthetic fibers.

Tissue sheets that particularly benefit from the method of this invention are premium quality throughdried tissue sheets that have a relatively high degree of resiliency and low stiffness. The basis weight of the tissue sheet can be from about 5 to about 70 grams per square meter.

Referring now to the tissue making process of this invention, the forming process and tackle can be conventional as is well known in the papermaking industry. Such formation processes include Fourdrinier, roof formers such as a suction breast roll, gap formers such as twin wire formers and crescent formers, and other suitable formers. A twin wire former may be preferred for higher speed operation. Forming wires or fabrics can also be conventional, the finer weaves providing greater fiber support and a smoother sheet and the coarser weaves providing greater bulk. Headboxes used to deposit the fibers onto the forming fabric can be layered or nonlayered, although layered headboxes are advantageous because the properties of the tissue can be finely tuned by altering the composition of the various layers. The throughdryers and throughdrying fabrics can also be of a conventional nature.

DETAILED DESCRIPTION OF THE PREFERRED EMBODIMENTS

Figure 1:
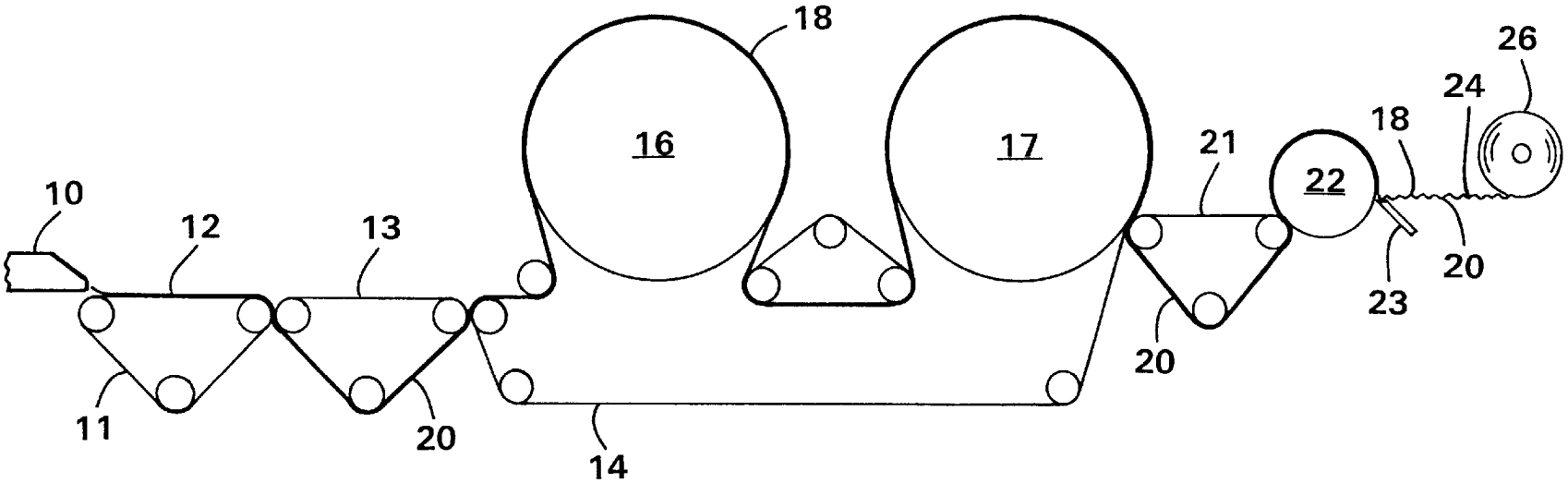
FIG. 1 is a schematic process flow diagram illustrating a method of making a creped throughdried web and winding the web into a parent roll.

Referring to FIG. 1, a schematic details the method for carrying out the present invention. A headbox 10 is used to deposit an aqueous suspension of papermaking fibers onto the surface of a forming fabric 11. The resulting wet web 12 is transferred to an optional fine mesh transfer fabric 13 and thereafter is transferred to a coarse mesh throughdryer fabric 14. In the illustrated process, two throughdryers 16 and 17 are used to dry the web 12. The web 12 may be partially dried in the first throughdryer 16 to a consistency of about 45 percent. The partially dried web 12 is then routed around at least a portion of the circumference of the second throughdryer 17 and further dried to a consistency of about 85 to about 95 percent.

The tissue web 12 has opposite major planar surfaces 18 and 20 which are referred to as the air side surface 18 and the fabric side surface 20. The air side surface 18 faces away from the throughdryer fabric 14 and towards the surfaces of the throughdryers 16 and 17. Correspondingly, the fabric side surface 20 faces toward the throughdryer fabric 14 and is in contact with it.

Upon exiting the second throughdryer 17, the tissue web 12 is transferred to a fine mesh fabric 21 and is pressed against the surface of a Yankee dryer 22 for final drying, if necessary. The fabric side surface 20 of the tissue web 12 is disposed against the surface of the Yankee dryer 22. The Yankee dryer 22 will further dry the tissue web 12 to a consistency of about 100 percent. The tissue web 12 is dislodged from the Yankee dryer 22 with a doctor (creping) blade 23 to produce a dried, creped tissue web 24 that is wound into a parent roll 26. The tissue web 12 is creped off the Yankee dryer 22 to obtain the creped tissue web 24 having a basis weight of about 15.2 pounds per 2880 square feet.

For simplicity, the various tensioning rolls schematically used to define the several fabric runs are shown but not numbered. It will be appreciated that variations from the apparatus and method illustrated in FIG. 1 can be made without departing from the scope of the invention. For example, additional dewatering of the wet tissue web 12 can be carried out, such as by vacuum suction, while the wet tissue web 12 is supported by the forming fabric 11. Furthermore, only a single throughdryer 16 may be used, if desired. Other changes to the process are also possible and will be recognized by those skilled in the art without departing from the spirit and scope of the present invention.

Figure 2:
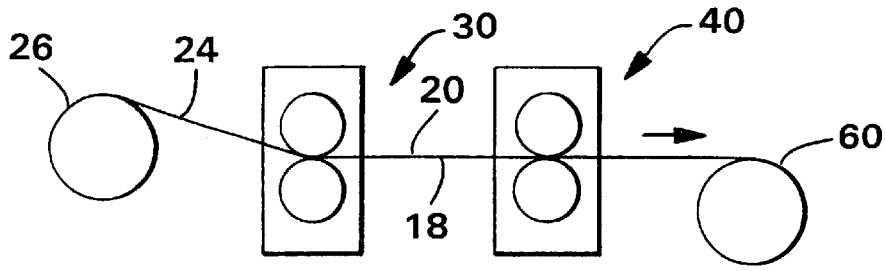
FIG. 2 is a schematic process flow diagram for a method of converting the tissue web using a calendering unit and an embossing unit.

Referring to FIG. 2, an off-line converting operation to calender and emboss the creped tissue web 24 is illustrated. The creped tissue web 24 is unwound from the parent roll 26 and transported in sequence to a calendering unit 30 and then to an embossing unit 40. The calendered and embossed tissue web 24 may then be wound at a rewinding unit 60. For example, the tissue web 24 may be wound onto tissue roll cores to form logs, which are subsequently cut to appropriate widths and the resulting individual tissue rolls can then be packaged (not shown).

Figure 3:
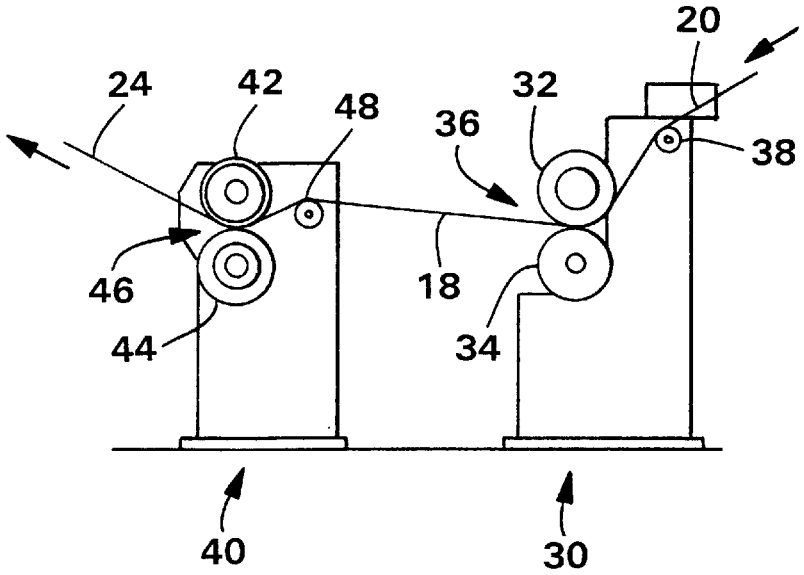
FIG. 3 representatively shows exemplary calendering and embossing units used in the converting process shown in FIG. 2.

Referring to FIG. 3, exemplary calendering and embossing units 30 and 40 are shown in greater detail. Note that in the winding and unwinding processes of FIGS. 1 and 2, the orientation of the creped tissue web 24 in the illustrated embodiment has been reversed so that the fabric side surface 20 is shown on the top and the air side surface 18 is shown on the bottom in FIGS. 2 and 3. Arrows are used to designate the direction of travel of the creped tissue web 24 through the calendering and embossing units 30 and 40.

The calendering unit 30 includes a pair of calendering rolls 32 and 34 that together define a calendering nip 36 therebetween. A spreader roll 38 is shown preceding the calendering nip 36, although other details of the calendering unit 30 are not shown for purposes of clarity.

The calendering nip 36 is a "soft-nip" wherein the calendering rolls 32 and 34 have different surface hardnesses and at least one of the rolls 32 and 34 has a resilient surface. In FIG. 3, the calender roll 32 is a smooth resilient roll and the calender roll 34 is a smooth steel roll. The resilient calendering rolls are sometimes referred to as soft covered calendering rolls. The actual material used to cover the exterior surface of the resilient calender roll 32 can include natural rubber, synthetic rubber, composites, as well as other compressible surfaces. A preferred material for the exterior surface of the resilient calender roll 32 is ethylene propylene diene polymer. This material is compressible and holds up well under pressure. Suitable resilient calendering rolls should have a Shore A surface hardness of from between about 65 to about 100 Durometer (approximately 75 to about 0 Pusey & Jones, respectively), preferably, from between about 75 to about 100 Durometer (approximately 55 to about 0 Pusey and Jones, respectively), and most preferably, from between about 85 to about 95 Durometer (approximately 35 to about 10 Pusey & Jones respectively). The use of a resilient calender roll 32 having an ethylene propylene diene polymer outer surface with a Shore A surface hardness of about 90 Durometer (approximately 25–30 Pusey & Jones) is particularly suited to the present process.

The pressure exerted by the calendering nip 36 is preferably less than about 225 pounds per linear inch, preferably, from between about 30 to about 200 pounds per linear inch, and most preferably, from between about 75 to about 175 pounds per linear inch. The creped tissue web 24 can be calendered to a caliper of about 0.01 inches (about 0.254 millimeters).

Upon exiting the calendering unit 30, the creped tissue web 24 is transported to an embossing unit 40. The embossing unit 40 includes a pattern roll 42 and a backing roll 44. The pattern and backing rolls, 42 and 44 respectively, together define an embossing nip 46 therebetween. A spreader roll 48 is shown preceding the embossing nip 46, although other details of the embossing unit 40 are not shown for purposes of clarity.

Embossing is a well-known mechanism to increase tissue sheet caliper, and it also provides an additional benefit by imparting a decorative pattern to the tissue web 24. Such decorative patterns are commonly formed by "spot embossing", which involves discrete embossing elements that are about 0.5 inch by 0.5 inch (about 1.27 by about 1.27 centimeters) to about 1 inch by 1 inch (about 2.54 by about 2.54 centimeters) in size, and thus form from between about 0.25 to about 1 square inch (about 0.635 to about 2.54 centimeters) in surface area. These discrete embossing elements are typically spaced about 0.5 inch to about 1 inch apart (about 1.27 to about 2.54 centimeters). The spot embossing elements are formed on the pattern roll 42, which is also referred to as an embossing roll, and are pressed into the creped tissue web 24.

The creped tissue web 24 can be embossed in the embossing unit 40 at a nip pressure of from between about 80 to about 150 pounds per linear inch.

Figure 4:
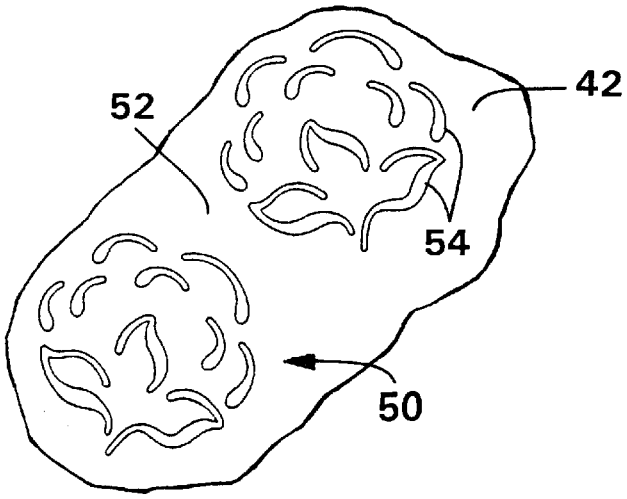
FIG. 4 representatively shows a plan view of a portion of the surface of an exemplary pattern roll used in the embossing unit shown in FIG. 3.

Referring to FIG. 4, a plan view of a portion of the surface of an exemplary pattern roll 42 is shown. The surface of the pattern roll 42 includes a plurality of discrete male spot embossing elements 50 that are separated by smooth land areas 52. The male spot embossing elements 50 define a decorative pattern, which in the illustrated embodiment is a series of cotton balls. The male spot embossing elements 50 may include a plurality of separate embossing element segments 54 which are raised above the surface of the land areas 52. In FIG. 4, each cotton ball is a spot embossing element 50 made up of ten individual embossing element segments 54.

The spaced-apart discrete spot embossing elements 54 can depict flowers, leaves, birds, animals, and the like. The embossing elements 54 can be formed on the pattern roll 42 by engraving or other suitable techniques known to those skilled in the art.

In particular embodiments, the male embossing element segments 54 protrude from the surface of the pattern roll 42 a distance or height which should be greater than about 0.04 inch (about 1.02 millimeters). Preferably, the male embossing element segments 54 will protrude above the surface of the pattern roll 42 a distance or height of from between about 0.045 inch to about 0.060 inch (about 1.143 to about 1.524 millimeters). Most preferably, the male embossing element segments 54 will protrude above the surface of the pattern roll 42 a distance or height of about 0.045 inch (about 1.143 millimeters). This relatively large distance or height enhances the embossing pattern definition. The width of the embossing element at its tip can be from between about 0.005 to about 0.50 inches (about 0.127 to about 12.7 millimeters). The sidewall angle of the male embossing element segments measured relative to a plane drawn tangent to the surface of the pattern roll 42 at the base of the embossing element is suitably from between about 90 degrees to about 130 degrees.

As disclosed in U.S. Pat. No. 5,904,812 issued May 18, 1999, and filed on even date herewith by Z. Salman et al. and entitled "Calendered And Embossed Tissue Products," high-bulk tissue products can be embossed with improved pattern clarity by processing the high bulk tissue webs sequentially through separate calendering and embossing units. This multiple step converting process provides a method of optimizing the balance between sheet caliper for winding tension and embossing element height for pattern definition. The result is an embossed, high-bulk tissue product with improved embossing pattern clarity.

As used herein, the term "pattern definition" refers to the extent to which the embossed pattern can be immediately identified by distinct impressions made by the embossing element. The term "pattern clarity" as used herein refers to the clearness of the pattern in the final product.

The backing roll 44 can be a smooth rubber covered roll, an engraved roll such as a steel roll matched to the pattern roll 42, or the like. The bonding nip may be set to a pattern roll 42/backing roll 44 loading pressure of from between about 80 to about 150 pounds per linear inch. For example, a loading pressure of about 135 pounds per linear inch work well such that the embossing pattern is imparted to the creped tissue web 24. The backing roll 44 can be any material that meets the process requirements. Typical materials used to form the exterior surface of the backing roll 44 include natural rubber, synthetic rubber and other compressible materials known to those skilled in the art. The backing roll 44 can have an exterior surface with a Shore A surface hardness of from between about 65 to about 85 Durometer, preferably, about 75 Durometer (approximately 75 to about 35 Pusey & Jones, respectively, and preferably about 55 Pusey & Jones).

EXAMPLES

The following Examples are provided to give a more detailed understanding of the invention. The particular amounts, proportions, compositions and parameters are meant to be exemplary, and are not intended to specifically limit the scope of the invention. In order to compare the effects of the orientation of the fabric and air side surfaces of the throughdried tissue 24, none of the Example sheets were embossed. The converting lines all ran at 10,000 feet per minute (at 3048 meters per minute).

Example 1

(Comparative)

A throughdried and creped tissue sheet was manufactured having a caliper of about 0.01 inch (about 0.254 millimeters)

and a basis weight of about 15.2 pounds per 2880 square feet. The tissue sheet was slit into narrow rolls for use on converting lines. A narrow roll of the throughdried and creped tissue was unwound and then rewound as a control. Basesheet samples were prepared for sensory evaluation from this converted roll. Thus, the tissue sheet of Example 1 was not calendered.

Example 2

(Comparative)

For Example 2, a narrow roll of throughdried and creped tissue as described in Example 1 was unwound, calendered, and then rewound. Basesheet samples were prepared for sensory evaluation from this converted roll.

The calendering unit included a smooth steel calendering roll and a smooth resilient calendering roll. The resilient calendering roll had an exterior covering formed of a composite polymer from Stowe Woodward Company, U.S.A., under the tradename MULTICHEM, with a Shore A hardness of 90 Durometer (approximately 25 Pusey & Jones). The calendering nip was set to 30 pounds per linear inch.

The tissue sheet was processed through the calendering nip such that the fabric side surface of the tissue sheet was disposed against the steel calendering roll and the air side surface was disposed against the resilient calendering roll.

Example 3

For Example 3, a narrow roll of throughdried and creped tissue as described in Example 1 was unwound, calendered, and then rewound. Basesheet samples were prepared for sensory evaluation from this converted roll. The components of the calendering unit and the operating conditions were the same as described in Example 2, although the positions of the steel calendering roll and the resilient calendering roll were transposed.

Thus, in Example 3 the tissue sheet was processed through the calendering nip such that the fabric side surface of the tissue sheet was disposed against the resilient calendering roll and the air side surface was disposed against the steel calendering roll.

The bath tissue sheets of Examples 1, 2 and 3 were submitted for sensory panel evaluation. The sensory panel utilized eleven individuals trained to compare tissue products and evaluate tactile properties. The panelists were asked to render numerical values for each sample tissue regarding the "Fuzzy, Gritty and Grainy" attributes. The "Fuzzy, Gritty and Grainy" attributes were recorded for both the air side surfaces and the fabric side surfaces. The stiffness and thickness of each sample was also recorded. For each Example, the tissue samples were die cut from the rolls to 8 by 4.5 inches (20.32 by 11.43 centimeters).

The Fuzzy attribute was ranked on a scale from 0 described as none/bald to 7 described as much/fuzzy. The panelists were asked to consider the amount of fibers, pile, fiber, nap, and fuzz on the tissue surface. The panelists were instructed to: place a single tissue sample flat on a smooth tabletop with the side to be tested facing up; and using the pads of the index and middle fingers, move in quarter-sized circular motions very lightly across several areas of the sample.

The Gritty attribute was ranked on a scale from 0 described as smooth to 7 described as gritty. The panelists were asked to consider the amount of sharp, prickly, abrasive particles or fibers felt on the surface of the sample. The panelists were instructed to place a single tissue sample on a table with the side to be tested facing up. With forearms/elbows resting on the table and using the full length of the fingers, the panelists slowly glided their fingers lightly across the entire surface 1 inch (2.54 centimeters) from the edge moving left to right. Each panelist used their other hand to rotate the tissue sample and stroke along all four directions. Each evaluated the grittiest direction.

The Grainy attribute was ranked on a scale from 0 described as smooth to 7 described as grainy. The panelists were asked to consider the pebbly texture of the tissue sample (feeling of grains of sand, rice), and to evaluate by considering the frequency, size, and hardness/firmness/rigidity of grains. It was noted that the panelist's perception could include shape, orientation and size of texture (pattern/embossing), small rounded particles, fibers, etc. The panelists were instructed to place a single tissue sample on a table with the side to be tested facing up. With their forearms/elbows resting on the table, each panelist used the pads of their index and middle fingers and slowly and gently moved the pads of their fingers across the surface going slightly into the surface of the sample. Each panelist moved the pads of their fingers across the entire surface 1 inch (2.54 centimeters) from the edge, moving left to right. The other hand of each panelist was used to rotate the tissue sample and stroke along all four directions. Each evaluated the grainiest direction.

Stiffness was ranked on a scale from 0 described as pliable/flexible to 7 described as stiff/rigid. The panelists were asked to consider the amount of pointed, rippled or cracked edges or peaks felt from the sample while turning in your hand. The panelists were instructed to place two tissue samples flat on a smooth tabletop. The bath tissue samples overlapped one another by 0.5 inches (1.27 centimeters) and were flipped so that opposite sides of the tissue samples were represented during testing. With forearms/elbows of each panelist resting on the table, they placed their open hand, palm down, on the samples. Each was instructed to position their hand so their fingers were pointing toward the top of the samples, approximately 1.5 inches (approximately 3.81 centimeters) from the edge. Each panelist moved their fingers toward their palm with little or no downward pressure to gather the tissue samples. They gently moved the gathered samples around in the palm of their hand approximately 2 to 3 turns.

Thickness was ranked on a scale from 0 described as thin to 7 described as thick. The panelists were asked to consider the relative depth of tissue (perceived distance between thumb and one/two fingers). The panelists were instructed to take a single tissue sample and gently hold the tissue sample with their thumb between their index and second fingers. Each panelist used their other hand to gently pull the tissue sample out of their first hand. This procedure was repeated several times on the lower edge of the tissue to evaluate the degree of thickness as their fingers came together off the edge of the tissue.

Figure 5:
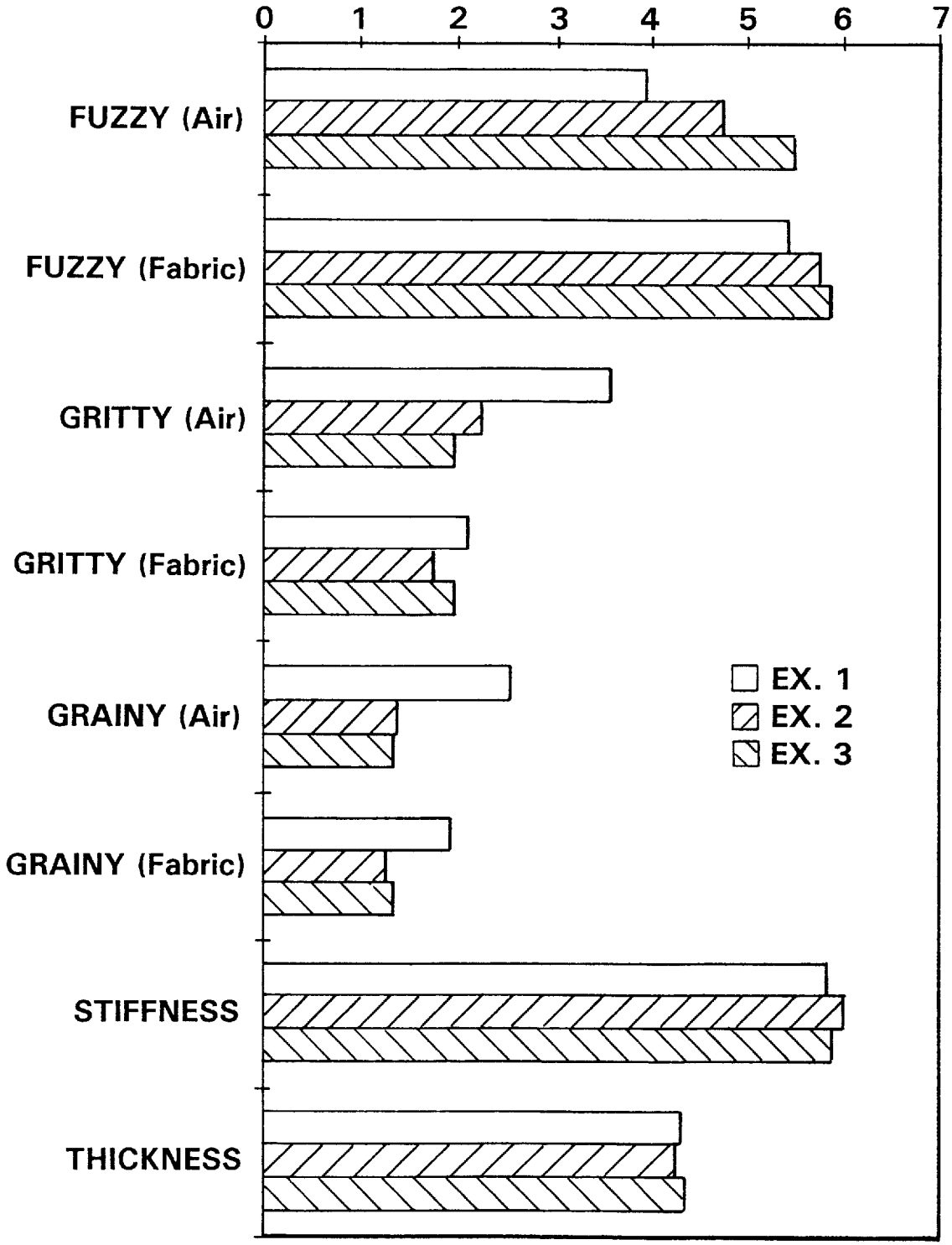
FIG. 5 representatively shows a graph of data collected as part of a sensory panel evaluation pertaining to Examples 1–3 described below.

The data collected from the sensory panel analysis is presented in Table 1 below and is graphically displayed in FIG. 5. The attribute values represent averages of all of the panelists.

TABLE 1

Sensory Panel Profile

| Attribute | Example 1 | Example 2 | Example 3 |
|---|---|---|---|
| Fuzzy (air side) | 3.94 | 4.74 | 5.49 |
| Fuzzy (fabric side) | 5.43 | 5.75 | 5.85 |
| Gritty (air side) | 3.56 | 2.25 | 1.98 |
| Gritty (fabric side) | 2.11 | 1.77 | 1.98 |
| Grainy (air side) | 2.55 | 1.41 | 1.35 |
| Grainy (fabric side) | 1.95 | 1.28 | 1.37 |
| Stiffness | 5.84 | 6.01 | 5.89 |
| Thickness | 4.31 | 4.26 | 4.35 |

Thus, the sensory panel comparisons indicate that soft-nip calendering with the fabric side oriented toward the resilient roll, represented by Example 3, increases the Fuzzy attribute of softness more than soft-nip calendering with a transposed orientation of the calendering rolls, represented by Example 2. As noted previously, increasing the Fuzzy attribute indicates improved softness. Because the Fuzzy value is greater on both the air side and the fabric side when the fabric side is oriented toward the resilient roll (Example 3), it follows that the overall softness of the tissue is better using this orientation.

The reduction of the Gritty and Grainy values on the air side of the tissue is a result of flattened crepe folds. Soft-nip calendering with the fabric side oriented toward the resilient roll (Example 3) increases the Fuzzy attribute at a 95 percent confidence level and directionally decreases the Gritty and Grainy attributes, resulting in a less two-sided sheet as compared to both Examples 1 and 2.

Example 4

A resilient roll having an exterior covering of ethylene propylene diene polymer was analyzed by measuring the penetration at varied loading levels of a hard mating roll into the resilient roll. For this analysis, penetration is defines as "the difference in position of the hard mating roll when it was just touching the resilient roll covering under no load (0 pounds per linear inch), and the distance the hard mating roll traveled into the resilient roll in a loaded state." The penetration was measured using a resilient roll with a total outside diameter of 21 inches (53.34 centimeters) and an exterior cover thickness of 0.625 inch (1.5875 centimeters). The mating roll and the resilient roll were analyzed at 2500 feet per minute (762 meters per minute) without water cooling.

The data collected from the analysis is presented in Table 2 below.

TABLE 2

Penetration of a Mating Roll into a Resilient Roll

| Loading (Pounds. Per Linear Inch) | Resilient Roll Hardness (Shore A Durometer) | Penetration: Hard/Soft (Inches) |
|---|---|---|
| 30 | 100 | .002 |
| 80 | 95 | .005 |
| 150 | 75 | .016 |
| 200 | 65 | .029 |

Table 2 shows that the smooth calender roll can penetrate the exterior covering of the resilient calender roll by a distance of from between about 0.002 inches to about 0.029 inches, specifically, a distance of from about 0.005 inches to about 0.029 inches, and more specifically, a distance of from about 0.005 inches to about 0.016 inches.

It will be appreciated that the foregoing examples, given for purposes of illustration, are not to be construed as limiting the scope of this invention, which is defined by the following claims and all equivalents thereto.

We claim:

1. A method for making a throughdried tissue sheet exhibiting improved softness while retaining adequate strength, said method comprising the steps of:

a) depositing an aqueous suspension of papermaking fibers onto an endless forming fabric to form a wet web;

b) transferring said wet web to a throughdrying fabric, said wet web having a fabric side in contact with said throughdrying fabric and an opposite air side facing away from said throughdrying fabric;

c) routing said wet web over a throughdryer to dry said web;

d) transferring said web to a Yankee dryer to further dry said web;

e) creping said web from said Yankee dryer to obtain a creped web having a basis weight of about 15.2 pounds per 2880 square feet; and f) calendering said creped web in a calendering unit having a smooth calender roll and a resilient calender roll, said resilient calender roll having an exterior covering formed of ethylene propylene diene polymer having a Shore A surface hardness of from between about 65 to about 100 Durometer, and said creped web being oriented such that said fabric side is disposed toward said resilient calender roll.

2. The method of claim 1 further comprising calendering said creped web in said calendering unit at a calendering nip pressure of from between about 30 to about 200 pounds per linear inch.

3. The method of claim 2 further comprising calendering said creped web in said calendering unit at a calendering pressure of from between about 75 to about 175 pounds per linear inch.

4. The method of claim 1 further comprising forming said exterior surface of said resilient roll to a Shore A surface hardness of from between about 85 to about 95 Durometer.

5. The method of claim 1 further comprising calendering said creped web in said calendering unit to a caliper of about 0.01 inches.

6. The method of claim 1 further comprising having said smooth calender roll penetrate said exterior covering of said resilient calender roll by a distance of from between about 0.002 inches to about 0.029 inches.

7. The method of claim 6 further comprising having said smooth calender roll penetrate said exterior covering of said resilient calender roll by a distance of from between about 0.005 inches to about 0.029 inches.

8. The method of claim 7 further comprising having said smooth calender roll penetrate said exterior covering of said resilient calender roll by a distance of from between about 0.005 inches to about 0.016 inches.

9. A method for making a throughdried tissue sheet exhibiting improved softness while retaining adequate strength, said method comprising the steps of:

a) depositing an aqueous suspension of papermaking fibers onto an endless forming fabric to form a wet web;

b) transferring said wet web to a throughdrying fabric, said wet web having a fabric side in contact with said throughdrying fabric and an opposite air side facing away from said throughdrying fabric;

c) routing said wet web over a throughdryer to dry said web;

d) transferring said web to a Yankee dryer to further dry said web;

e) creping said web from said Yankee dryer to obtain a creped web having a basis weight of about 15.2 pounds per 2880 square feet;

f) calendering said creped web in a calendering unit having a smooth calendering roll and a resilient calendering roll, said smooth calendering roll being formed of steel and said resilient calendering roll having an exterior covering formed of ethylene propylene diene polymer having a Shore A surface hardness of between about 65 to about 100 Durometer, and said creped web being oriented such that said fabric side is disposed toward said resilient calendering roll; and g) embossing said creped web in an embossing unit having a pattern roll and a backing roll, said creped web being oriented such that said fabric side is disposed toward said pattern roll.

10. The method of claim 9 further comprising calendering said creped web in said calendering unit at a calendering nip pressure of from between about 30 to about 200 pounds per linear inch.

11. The method of claim 6 further comprising calendering said creped web in said calendering unit at a calendering nip pressure of from between about 75 to about 175 pounds per linear inch.

12. The method of claim 9 further comprising forming said exterior surface of said resilient roll to a Shore A surface hardness of from between about 85 to about 95 Durometer.

13. The method of claim 9 further comprising embossing said creped web in said embossing unit at an embossing nip pressure of from between about 80 to about 150 pounds per linear inch.

14. The method of claim 5 further comprising forming an exterior surface of said backing roll to a Shore A surface hardness of from between about 65 to about 85 Durometer.

15. A method for making a throughdried tissue sheet exhibiting improved softness while retaining adequate strength, said method comprising the steps of:

a) depositing an aqueous suspension of papermaking fibers onto an endless forming fabric to form a wet web;

b) transferring said wet web to a throughdrying fabric, said wet web having a fabric side in contact with said throughdrying fabric and an opposite air side facing away from said throughdrying fabric;

c) routing said wet web over a throughdryer to dry said web;

d) transferring said web to a Yankee dryer to further dry said web;

e) creping said web from said Yankee dryer to obtain a creped web having a caliper of about 0.01 inches and a basis weight of about 15.2 pounds per 2880 square feet;

f) winding said creped web to form a roll;

g) unwinding said roll and processing said unwound creped web sequentially through both a calendering unit and an embossing unit, said calendering unit including a smooth calendering roll and a resilient calendering roll, said smooth calendering roll being formed of steel and said resilient calendering roll having an exterior covering formed of ethylene propylene diene polymer having a Shore A surface hardness of from between about 75 to about 100 Durometer, and said embossing unit including a pattern roll and a backing roll, wherein said creped web is oriented with said fabric side disposed toward said resilient calendering roll and toward said pattern roll; and h) rewinding said calendered and embossed web.

16. The method of claim 15 further comprising calendering said creped web in said calendering unit at a calendering nip pressure of from between about 30 to about 200 pounds per linear inch.

17. The method of claim 15 further comprising having said smooth calender roll penetrate said exterior covering of said resilient calender roll by a distance of from about 0.002 inches to about 0.029 inches.

18. The method of claim 17 further comprising having said smooth calender roll penetrate said exterior covering of said resilient calender roll by a distance of from between about 0.005 inches to about 0.029 inches.

19. The method of claim 18 further comprising having said smooth calender roll penetrate said exterior covering of said resilient calender roll by a distance of from between about 0.005 inches to about 0.016 inches.

* * * * *